United States Patent [19]

de Putter et al.

[11] 4,435,493

[45] Mar. 6, 1984

[54] POROUS REUSABLE ZNO ELECTROPHOTOGRAPHIC ELEMENT

[75] Inventors: Jan A. de Putter; Paul J. H. Tummers, both of Velden, Netherlands

[73] Assignee: Oce-Nederland B.V., Venlo, Netherlands

[21] Appl. No.: 329,407

[22] Filed: Dec. 10, 1981

[30] Foreign Application Priority Data

Jan. 15, 1981 [NL] Netherlands ..... 8100163

[51] Int. Cl.[3] ..... G03G 5/087

[52] U.S. Cl. ..... 430/87; 430/96

[58] Field of Search ..... 430/87, 90, 91, 92, 430/93, 96

[56] References Cited

U.S. PATENT DOCUMENTS

| | | | |
|---|---|---|---|
| 3,347,670 | 10/1967 | Nelson et al. | 430/96 |
| 3,378,370 | 4/1968 | Brancato | 430/87 |
| 3,428,452 | 2/1969 | Giaimo | 430/91 |
| 3,857,708 | 12/1974 | Verhille et al. | 430/96 |
| 4,105,448 | 8/1978 | Miyatuka et al. . | |
| 4,283,474 | 8/1981 | Kaneko et al. | 430/87 X |
| 4,335,195 | 6/1982 | Nishigaki et al. | 430/96 X |

FOREIGN PATENT DOCUMENTS

| | | | |
|---|---|---|---|
| 910702 | 9/1972 | Canada | 430/96 |
| 2952664 | 7/1980 | Fed. Rep. of Germany . | |
| 2015764 | 9/1979 | United Kingdom . | |

*Primary Examiner*—Roland E. Martin, Jr.

*Attorney, Agent, or Firm*—Albert C. Johnston

[57] ABSTRACT

A reusable electrophotographic element comprising a photoconductive layer containing sensitized zinc oxide particles and first and second binding agents that are incompatible is produced by employing as the first binding agent a macromolecular compound that has a higher affinity to zinc oxide than the second binding agent, is largely deposited on the zinc oxide, has an average molecular weight of at least 12,000 and is present in the photoconductive layer in an amount of 1.5 to 9% by weight calculated on the zinc oxide, with the second binding agent present in substantially larger amount. The photoconductive layer is formed of agglomerates of zinc oxide particles substantially enveloped in the first binding agent, which agglomerates have a diameter of between 2.5 and 6 μm and are stuck together by portions of the second binding agent, thus providing a substantially porous photoconductive layer having a negative charge density of at most 1 m Coulomb per $m^2$. The photoconductive layer is produced by mixing together the zinc oxide, any desired dye sensitizer, and solutions of the binding agents in one or more volatilizable solvents, applying a layer of the resulting dispersion to a substrate suited for electrophotography and drying the applied layer. The electrophotographic element has a very high resistance to both electrical and mechanical influences, thus being suited for long service life in an electrophotographic copying machine.

6 Claims, 2 Drawing Figures

POROUS REUSABLE ZNO ELECTROPHOTOGRAPHIC ELEMENT

Figure 1:
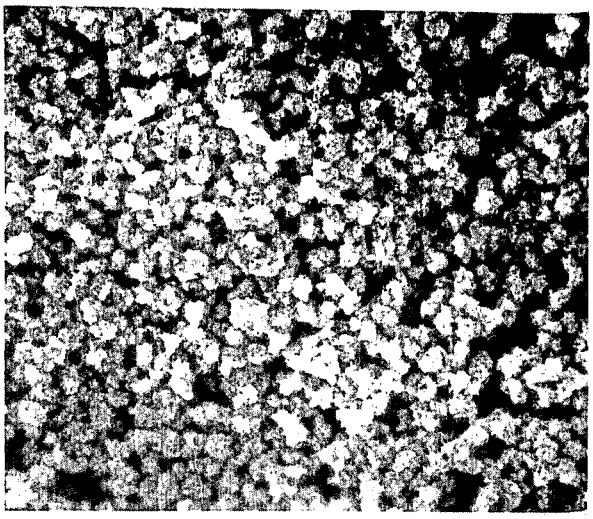

The present invention relates to a reusable electrophotographic element and to a process for producing such an electrophotographic element.

Reusable electrophotographic elements are employed particularly in indirect electrophotographic copying machines which produce copies by a succession of steps that include charging the electrophotographic element, exposing it imagewise and developing it with a developer powder and transferring the resulting powder image to a receiving material and fixing it thereon. After transferring the powder image, the electrophotographic element is cleaned and can be reused for copying. Reusable electrophotographic elements are also employed in copying machines in which a charge pattern obtained by charging and exposing the element is transferred to a receiving material and developed thereon.

For the use in indirect electrophotographic copying machines there is a continuing need to increase the number of times the electrophotographic element can be used to make satisfactory copies. This is especially important to high-volume copying machines, because an element having a short useful life has to be renewed too often. A short useful life is a drawback particularly in the case of electrophotographic elements having a photoconductive layer based on zinc oxide dispersed in a binding agent. Although the frequency of necessary renewal of such an electrophotographic element has been reduced by using the element in the form of a long endless belt, so that another part of the belt is continually used for the image forming process, this technique has disadvantages in that a large part of the space in the copying machine is occupied by the belt and in that renewal of the belt is a rather cumbersome task requiring special care, because a long photoconductive belt is not easy to handle.

The useful life of an electrophotographic element based on zinc oxide dispersed in a binder is limited by various electrical and mechanical influences, such as the following. With repeated charging of the photoconductive layer the dyes used for sensitizing the zinc oxide tend to be decomposed. This is a result, it is believed, of the formation of oxidizing substances such as ozone, nitrogen oxides, and ions, by the charging process. The charging also causes the formation on the surface of the zinc oxide-binder layer of hygroscopic substances, probably comprising oxidized organic binder, which disturb the image forming process and do so particularly at high relative humidities because in that case they render the surface of the photoconductive layer electrically conductive. Furthermore, conductive spots resulting from electrical breakdown will appear locally on the photoconductive layer.

Among the mechanical influences which limit the useful life of the electrophotographic element are wear of the photoconductive layer, as caused by its moving contact with other materials or objects in the developing, transfer and cleaning stations of the copying machine, and tensile and pressure loads which result from the driving, bending and bending back of the endless electrophotographic belt element as it is passed over various rollers.

A more particular form of mechanical load on the photoconductive element is involved in the use of a transfer system in which the developed image is transferred first onto an intermediate having a silicone rubber surface and then from that intermediate to the receiving material. Such a transfer system is often used with development by use of a one-component developer powder, as a result of which this developer and the use of an intermediate in the transfer process reduce the degradation of the photoconductive layer as compared with other developing and transfer systems. Even in this practice, however, an increased temperature and pressure involved in transferring the images onto the intermediate will cause a certain degree of plastic deformation of the photoconductive layer to set in at its surface.

All the mechanical loads mentioned above cause changes in the structure of the photoconductive layer and reduction of the adherence of the zinc oxide particles to the binding agent of the layer, thus changing the electrophotographic properties of the element, for the most part, unfavorably.

Various proposals have been made for extending the useful life of electrophotographic elements having a photoconductive layer formed of a dispersion of zinc oxide in a binder. For example, it has been proposed simply to wash off the electrophotographic element at regular intervals, which in itself seems to be a simple procedure but actually is not practicable in a high-volume copying machine because then the electrophotographic element has to be removed frequently from the machine, as often even as once or twice a day, to wash it off with an appropriate liquid and re-dry it carefully.

It has also been proposed, many times, to provide the zinc oxide-binder layer with a top layer of a polymer, but in practice this too does not work satisfactorily. If the top layer is very thin it has little effect, and if the top layer is thick enough to have a significant effect then a residual voltage too high to be removed by prolonged exposure will be left on the background after the charging and imagewise exposure steps. Due to the fact that, generally, the surface of a zinc oxide-binder layer is not smooth, a top layer applied thereon will have a varying thickness, which results in an unequal charge distribution. This is particularly detrimental in the background and the light gray tones of an image.

A third proposal for extending the useful life of electrophotographic elements having a photoconductive layer based on zinc oxide is described in U.K. Patent application No. 2 015 764. This relates to pretreating zinc oxide with a solution containing a sensitizing dye and a first binding agent in the form of a hydrophilic resin, such as polyvinyl alcohol, polyvinyl pyrrolidone or polyvinyl butyral, in a solvent. After being dried, the zinc oxide is covered with the dye and with a quantity of the resin which, calculated on the zinc oxide, is smaller than 1% by weight. The resulting product is then dispersed in a second binding agent having an acid value of from about 10 to 15, which has been dissolved in a solvent that does not dissolve the hydrophylic resin. Using this dispersion, a layer having a dry thickness of 15 to 20 $\mu$m is coated on a metal plate, such as aluminum.

According to Examples 1 and 2 of the U.K. patent application, the resulting product can be charged and discharged 7,000 to 10,000 times without its photosensitivity being deteriorated too seriously. Repeated charging and discharging, however, gives only an impression of the resistance to electrical load. As is evidenced by Example 8 of the U.K. patent application, the useful life is low when copies are made in a copying machine where the mechanical load also plays a role; that example mentions making 500 copies under moist conditions. According to the U.K. application, the useful life in a copying machine can be extended by measures such as washing off at regular intervals and/or applying a silicone resin top layer, and also by handling the electrophotographic element under dry conditions. Although dry conditions can be achieved in a humid environment by the use of heating elements, this not only is energy-consuming but also causes discomfort in the season in which a high relative humidity prevails in copying rooms.

Another process for pretreating zinc oxide is described in German Patent application No. 29 52 664. In that process a binding agent is precipitated on zinc oxide by dispersing the zinc oxide in a solution of the binder and adding a liquid in which the binder does not dissolve, or by dispersing the zinc oxide in a solution of the binder in a solvent and a non-solvent and subsequently evaporating the solvent. The zinc oxide thus obtained is filtered off and dried and then is processed with a second binding agent to form a photoconductive layer. A product resulting from that process is described as being usable as many as 10,000 times in a specified copying machine. However, the useful life is considerably lower if a photoconductive element having such a photoconductive layer is used in a copying machine provided with a magnetic brush developing device employing one-component developer powder, and with a transfer system employing a heated intermediate. Moreover, the process has the drawback of being time-wasting, because its various steps require a dispersing time of some hours, and of requiring heating for even a longer time to dry the product after precipitation of the binding agent on the zinc oxide.

The object of the present invention is to provide an electrophotographic element which can be prepared in a simple way and can be reused frequently in a copying machine without employing additional expedients, such as washing off at regular intervals, keeping dry, and top layers, with the associated disadvantages, and which moreover can be used in a copying machine provided with a heated intermediate transfer member over a much longer time than the photoconductive elements already known.

According to this invention, a reusable electrophotographic element is provided which is similar to certain known elements in that it comprises a substrate suited for use in electrophotography and a photoconductive layer containing sensitized zinc oxide particles and first and second binding agents that are incompatible, the first binding agent having a higher affinity to zinc oxide than the second binding agent and being largely deposited on the zinc oxide. The electrophotographic element of this invention, however, is characterized in that the first binding agent is a macromolecular compound having an average molecular weight of at least 12,000 and is present in the photoconductive layer in an amount of 1.5 to 9% by weight calculated on the zinc oxide, and in that the amount of the second binding agent contained in the photoconductive layer is larger than that of the first agent; and the photoconductive layer is composed of agglomerates of zinc oxide particles substantially enveloped in the first binding agent, which agglomerates have a diameter between 2.5 and 6 μm and are stuck together by the second binding agent to form a porous layer having a negative charge density of at most 1 m Coulomb per $m^2$.

It has been found that the photoconductive layer of an electrophotographic element according to the present invention has a very high resistance both to electrical influences and to mechanical influences, including the influences caused by pressure and increased temperature in a transfer system employing an intermediate transfer member. As a consequence, by the use of an electrophotographic element according to the invention a very large number of copies can be made on the same portion of the photoconductive layer without suffering serious deterioration of its electrophotographic properties.

These properties and results of the new element are considered attributable, on the one hand, to the zinc oxide particles being fully covered with the first binding agent, resulting in an effective protection of the sensitizing dyes, and on the other hand to a high pore volume resulting in the layer having a remarkably low negative charge density, which per $m^2$ is not higher than 1 m Coulomb and is in the range of from 0.4 to 0.7 m Coulomb for the most suitable photoconductive layers. In contrast, a charge density of 1.5 or higher is measured with photoconductive layers obtained according to the above-mentioned UK and German applications, and with other zinc oxide-binder layers known for indirect electrophotographic application, which contain only one binding agent or contain mixtures of compatible binders. The low charge density has as a consequence that, at a certain potential, less charge is deposited to the photoconductive layer, fewer oxidation products thus being formed on the surface. The greatly improved mechanical properties are believed to be partially caused by the high volume of open pores. Bending of the photoconductive layer could indeed result, for example, in the formation of small tears; but due to the large open pores, bending will occur more readily and result less fast in the zinc oxide particles being torn off the binding agent. For the same reason, the squeezing effect of a heated transfer medium could result far less rapidly in the zinc oxide particles being torn off the binding agent. Moreover, a considerably longer time will be required before the volume of the pores can become so filled up with degraded material that the properties of the layer are changed substantially.

A photoconductive layer made with two incompatible binding agents and open pores has been described in U.S. Pat. No. 3,857,708, which does not relate otherwise to electrophotographic elements suitable for repeated use. In the layers described in that patent the zinc oxide particles are not enveloped in the first binding agent, with the result that free contact with the ambient atmosphere is possible. Also the typical structure of more or less spherical agglomerates is missing; as shown in FIG. 5 of the patent, the zinc oxide particles are distributed at random and particles are found at the walls of the pores. The structure of such a layer, when used repeatedly, causes the sensitizing dyes to be bleached out rapidly, and after being used several times for image formation the electrophotographic element will soon be rendered unusable. This is most likely a consequence of the method used to produce the photoconductive layer, as it is to be obtained by dispersing the zinc oxide in an admixture of liquids in which the two binding agents remain dissolved, then slowly drying the mixture at a relatively low temperature to evaporate one of the solvents and gradually precipitate one of the binding agents, and then precipitating the second binding agent in a subsequent drying stage at a higher temperature.

The photoconductive element according to the present invention can be produced by mixing together the zinc oxide, the first and second binding agent, one or more solvents for dissolving these agents and, if desired, one or more sensitizing dyes, and then applying a layer of the resulting mixture to a substrate that is suitable for electrophotographic purposes and drying the applied layer; the binding agents and the solvent or solvents for dissolving them having been preselected in a combination that produces two inmiscible liquid phases during the mixing. The zinc oxide can be presensitized by treating it with a dyestuff solution, but the dye or dyes can also be added to the dispersion in the form of a solution, e.g. of 0.5 to 1% by weight, in methanol. The zinc oxide has such a strong affinity to sensitizing dyes that these are nearly quantitatively adsorbed to the zinc oxide. Use can also be made of so-called pink zinc oxide, such as that obtained by treating zinc oxide with ammonia and carbon dioxide followed by heating, as described in U.K. Patent Specification No. 1,489,793. Although the sensitization of pink zinc oxide with dye sensitizer is preferred, this zinc oxide can be used without such sensitizers because it already possesses a reasonable sensitivity to visible light. Any dye commonly used to sensitize well-known zinc oxide-binder layers can be applied as sensitizing dye fcr the photoconductive layers according to the invention, such as for instance triphenylmethane dyes, bromophenol blue, chlorobromophenol blue, Rose Bengal, erythrosin, eosin or fluorescein or admixtures of such dyes. The amount of dye is customary as well. Very suitable amounts range between 0.1 and 1% by weight, calculated on the zinc oxide.

The sequence of adding the various ingredients for the mixing can be chosen at will, because, due to their high affinity to zinc oxide, the sensitizing dyes and the first binding agent land on the surface of the zinc oxide particles. However, the dispersing time should be sufficiently long to effect binding of these ingredients to the surface of the zinc oxide. A short dispersing time of about 10 or 15 minutes will suffice if a solution of the second binding agent is added to a dispersion of sensitized zinc oxide in a solution of the first binding agent. Because of this short dispersing time, the procedure in which the solution of the second binding agent is added last, is preferred. In addition, by employing this preferred procedure a photoconductive layer having remarkably accurately reproducible properties is obtained.

Mixing of the solutions of the first and second binding agents results in separation of the mixture into two liquid phases. When zinc oxide is already present in the system or is added, a heterogeneous phase will be formed which consists of small spheres containing the zinc oxide particles in a concentrated solution of the first binding agent, with any added sensitizing dye fully adsorbed to the surface of the zinc oxide particles. The homogeneous phase of the system contains practically all of the second binding agent and the remainder of the solvent or solvents, although small amounts of the second binding agent may be incorporated in the heterogeneous phase, while also a small percentage of the first binding agent may be left in the homogeneous phase.

It is remarkable that upon employing various binding agents, the spheres formed in the mixed layer composition always have the same diameter of approximately 8 μm if, calculated on the zinc oxide, approximately 1.5 to 6% by weight of the first binding agent is used. By reducing the amount of the first binding agent to below 1.5% by weight, the size of the spheres decreases quickly, and the useful life of the final product prepared under those conditions also decreases as a result of the zinc oxide particles being no longer effectively enveloped in the first binding agent. Upon increase of the amount of first binding agent from about 6 to 8% by weight, the size of the spheres increases and also the favorable properties of the photoconductive layer formed. When the amount of the first binding agent is raised above 8% by weight, the useful life of the final product will soon be shortened, but at amounts up to about 9% by weight it is maintained at a high level. When percentages of first binding agent exceeding 8% are used, it is very likely that during the formation of the photoconductive layer the structure of the spheres is disturbed increasingly, or a less uniform layer is formed increasingly, because the spheres become too big for a normal thickness of the layer or because the dispersion shows too great a tendency to deposit. For this reason it is necessary for the formation of a product according to the invention that the amount of the first binding agent be in the range of between 1.5 and 9% by weight. For obtaining an optimal result a percentage of the first binding agent in the range of between 4 and 8% by weight, calculated on the zinc oxide, is preferred.

The amount of the second binding agent is not critical so long as it is larger than that of the first binding agent. Even an amount of second binding agent eight times that of the first binding agent can be used. An amount sufficient to bring the total quantity of binding agent to a zinc oxide to binder weight ratio of between 3:1 and 8:1, as is customary for well known zinc oxide-binder layers, will generally be sufficient for forming the aforesaid spheres and forming a proper photoconductive layer. According to the invention, however, the ratio of zinc oxide to total binder can be set at considerably lower values, for instance at 2:1, at which ratio the known zinc oxide-binder layers made with one binder no longer produce a usable product. The most favorable results are achieved with photoconductive elements according to the invention in which the photoconductive layer contains an amount of second binding agent approximately 3 to 6 times larger than the amount of first binding agent. Accordingly, the ratio of zinc oxide to total binder is preferably set at a value between 2.5:1 and 5:1.

After a photoconductive layer according to the invention is applied on a substrate and dried, the heterogeneous structure of the dispersion from which the layer has been formed will remain recognizable. Due to evaporation of the solvent or solvents, the spheres of approximately 8 μm will shrink to form agglomerates having a diameter of between 2.5 and 3.5 μm, and spheres having a diameter, for example, of about 12 μm will shrink to form agglomerates of approximately 5 μm in diameter. The second binding agent in the homogeneous phase of the dispersion does not remain homogeneous but, on the one hand, forms a thin film on the agglomerates of the zinc oxide particles already enveloped in the first binding agent and, on the other hand, sticks the agglomerates together to form a very porous layer of which the air content is more than 1.5 times that of layers obtained from a dispersion of zinc oxide, or of zinc oxide previously enveloped with resin, in a single binding agent.

The binding agents for the electrophotographic element according to the invention can be selected from a large group of polymers so long as a suitable solvent or solvent mixture can be found in which the polymers will separate into two liquid phases. It cannot be predicted in advance which system of incompatible binding agents will result in a separation of liquid phases, and which in a separation of a solid phase. The suitable combinations can be determined experimentally, by mixing the binding agents with solvents and visual observation of the mixture. Moreover, the first binding agent must form the spheres referred to above in the presence of zinc oxide and the second binder solution. These conditions can be satisfied, if the first binding agent has an average molecular weight of at least 12,000 and contains polar groups that are at least as strong as those of the second binding agent. In such cases, the first binding agent separates from the mixture in the form of a concentrated solution having a higher affinity to zinc oxide than the diluted solution of the second binding agent. If the molecular weight of the first binding agent is lower than 12,000, no spheres will be formed in the dispersion and the photoconductive layer made of it will have a considerably lower useful life. The cause of this is not known.

Photoconductive elements having optimal properties are obtained when the second binding agent is a binder that also produces optimal properties when used in prior art photoconductive layers containing zinc oxide and one binding agent. Such binding agents, as most used in practice, all have a relatively weakly polar character and in most cases are selected from among the polyvinyl esters, such as polyvinyl acetate, acrylate resins such as copolymers of ethyl acrylate and styrene, alkyd resins, or mixtures of such polymers. These polymers dissolve in solvents that form no hydrogen bridges, or practically none, such as aromatic hydrocarbons having a boiling point between 110° and 150° C.; for instance, toluene, the xylenes and ethyl benzene. When selecting this weakly polar type of polymers for use as second binding agents in combination with such solvents, polymers which are very suitable for use as the first binding agent are, inter alia, phenoxy resins, linearly saturated polyesters, polyvinyl acetals such as polyvinyl formal or polyvinyl butyral, and cellulose derivatives including ethyl cellulose and cellulose esters such as cellulose acetate butyrate. Of these binding agents, a phenoxy resin is preferred for use in combination with a styrene acryate copolymer as second binder. The polymers mentioned as first binding agents are more difficultly soluble in solvents that form no hydrogen bridges, or practically none, such as toluene. In some cases, a solvent that forms hydrogen bridges will then be necessary to dissolve the first binding agent, in which event a solvent is preferred which is individually miscible with, and has a lower boiling point than, the non-hydrogen-bridge forming solvent. Such a miscible, lower boiling solvent may be selected from the ketones, esters, alcohols, or cyclic ethers such as tetrahydrofuran. The lower boiling point is desirable since the structure of the layer formed may be disturbed if the solvent for the first binding agent is the last to evaporate upon drying.

Weakly polar polyvinyl esters or acrylate resins can also be used as first binding agents, in which case the second binding agent should be selected from the polymers having no or nearly no polar character, such as polystyrene or polyvinyl carbazole. Such combinations yield a product having reasonably good but not optimal properties. This was unexpected, as an entirely useless product is obtained when polystyrene and polyvinyl carbazole are used as the only binding agent in zinc oxide-binder layers. A similar situation occurs if the binders are selected from strongly polar polymers, such as partially or substantially entirely saponified polyvinyl acetate, for which a strongly polar solvent containing water is required. In this case also no more than a reasonably good result is achieved, which may be due to small amounts of strongly polar solvent being left in the layer formed, in spite of intensive drying, and possibly also to a displacement of sensitizing dyes by the strongly polar solvent with resulting less intimate adherence of the dye to the zinc oxide particles.

The substrate may be any substrate that is suitable for electrophotographic purposes, such as metal or an electrically insulating material coated with a conductive layer of metal, or a conductive plastic layer such as a dispersion of carbon in cellulose acetate butyrate or in a vinylchloride vinylacetate-maleic acid anhydride terpolymer hardened by means of a melamine-formaldehyde precondensate. If desired, an intermediate layer such as a thin binding layer or barrier layer may be applied between the substrate and the photoconductive layer. In principle, paper also is usable, but preferably it is not used as such because ordinary paper substrates will wear out before the photoconductive layer will show signs of degradation. Paper that is reinforced in one way or another, for instance by having each side provided with a plastic layer, can of course be used without difficulty.

The following detailed examples further illustrate practices of the invention.

EXAMPLE 1

A solution was prepared by mixing 6.6 g of phenoxy resin (Rütapox 0717 of Bakelite GmbH, Germany) having an average molecular weight between 25,000 and 30,000 in 46.2 g of tetrahydrofuran and 85.8 g of toluene.

The following ingredients were added to the solution:

100 g of pink zinc oxide obtained, according to U.K. Patent Specification No. 1,489,793, by treating an electrophotographic zinc oxide with ammonia and carbon dioxide gas followed by heating to a constant weight at a temperature of 175° C.;

0.4 g of bromochlorophenol blue; and 20 g of toluene.

The dispersion was shaken with glass beads in a holder for 15 minutes and then 53.2 g of a 50% by weight solution of a styrene acrylic copolymer in toluene (E 048 obtainable from De Soto Inc., USA) were added.

The dispersion was shaken for a further 15 minutes with glass beads in a holder and then was applied to form a layer having a dry weight of 20 g per $m^2$ on a polyethylene terephthalate film provided on each side with a conductive layer composed of a dispersion of carbon in cellulose acetate butyrate. The applied layer was dried with hot air to a constant weight.

The photoconductive element so produced could be charged up to 366 Volt. A light energy of 14 m Joule per $m^2$ was required for discharging it to 8 Volt, using a xenon flash lamp through a filter having a passage of 400 to 750 nm. The negative charge density at maximum charging was 0.55 m Coulomb per $m^2$. This was determined by first charging the layer fully with negative charges then neutralizing it with positive charges and measuring the quantity of supplied positive charge necessary for neutralization. The photoconductive element was mounted in a copying machine in which it was subjected repeatedly to the following processing steps: charging to 60% of the maximum potential by means of a scorotron, imagewise exposing, developing with a conductive one-component developer powder, transferring the powder image via an intermediate medium comprising a layer of silicone rubber on paper, and cleaning with a magnetic brush. After 40,000 copying operations, a 40% higher light input permitted copies of good quality still to be produced from the same element.

Using the same method and composition but leaving out the zinc oxide, it was found that the binding agents together with the solvents produce a separation into two liquid phases. In the presence of zinc oxide, spheres having a diameter of approximately 10 μm were measured in the dispersion, which spheres after drying of the layer formed were discernable as agglomerates having a diameter of approximately 4.5 μm.

EXAMPLE 2

A solution was prepared by mixing 4 g of linearly saturated polyester having an average molecular weight between 20,000 and 30,000 (Vitel PE 222 of Company Francaise Goodyear) in 20 g of tetrahydrofuran and 60 g of toluene.

The following ingredients were added to the solution:

100 g of pink zinc oxide (prepared according to the U.K. Patent Specification No. 1,489,793) and 0.4 g of bromochlorophenol blue.

The dispersion was shaken with glass beads in a holder for 15 minutes and then 42 g of a 50% by weight solution of a styrene ethyl acrylate copolymer in toluene (E 048 obtainable from De Soto Inc., USA) and 80 g of toluene were added.

The dispersion was shaken for a further 15 minutes with glass beads in a holder and then was applied to form a layer having a dry weight of 20 g per $m^2$ on a polyethylene terephthalate film provided on each side with a conductive layer composed of a dispersion of carbon in cellulose acetate butyrate. The applied layer was dried with hot air to a constant weight.

The photoconductive element so produced could be charged up to 300 Volt, and the negative charge density at maximum charging was 0.64 m Coulomb per $m^2$. Discharging down to a residual voltage of 3 Volt required a light energy of 13.5 m Joule per $m^2$ (using the light source mentioned in Example 1).

In the same copying machine as was used in Example 1 a very high useful life was noted as well. In this case also the separation into liquid phases was demonstrated by use of the same formula but leaving out the zinc oxide. In the presence of zinc oxide, spheres having a diameter of approximately 8 μm were measured in the dispersion, which spheres after drying of the layer formed were discernable as agglomerates of approximately 3 μm in diameter.

EXAMPLE 3

A solution was prepared by mixing 4.5 g of polyvinyl formal (Formvar 770 of Shawinigan Ltd., England) in 28 g of tetrahydrofuran.

The following ingredients were added successively:

100 g of tetrahydrofuran, 0.5 g of bromochlorophenol blue and 100 g of zinc oxide (Electrox 3500 of Durham Chemicals Ltd., England).

The mixture was shaken with glass beads in a holder for 15 minutes. Then 50 g of a 50% by weight solution of a styrene-ethyl acrylate copolymer in toluene (Synolac 620 S of Crayvalley Products, England) and 75 g of toluene were added.

The dispersion was shaken for a further 15 minutes with glass beads, and subsequently a layer of this dispersion was applied to a polyethylene terephthalate foil coated on each side with a layer of aluminum. The applied layer was dried with hot air and had a dry weight of 21 g per $m^2$.

The resulting photoconductive element could be charged up to 357 Volt. Discharging it down to 10 Volt required a light energy of 25 m Joule per $m^2$, using the light source described in Example 1. The negative charge density at maximum charging was 0.40 m Coulomb per $m^2$. In the same copying machine as used in Example 1 a very large number of good copies was prepared again. The photoconductive element then showed wear in the aluminum layer only, at the rear side; the photoconductive layer was still in a well usable condition.

Using the same method and composition but leaving out the zinc oxide, it was found that the binding agents together with the solvents produced a separation into two liquid phases. In the presence of zinc oxide, spheres having a diameter of approximately 8 μm were measured in the dispersion, which spheres after drying of the layer formed were discernable as agglomerates having a diameter of approximately 3 μm.

EXAMPLE 4

A solution was prepared by mixing 4 g of polyvinyl butyral having a molecular weight of 30,000 (Pioloform BL 18 of Wacker Chemie GmbH, Germany) and 104 g of toluene.

The following ingredients were added:

100 g of pink zinc oxide (prepared according to the U.K. Patent Specification No. 1,489,793) and 0.4 g of bromochlorophenol blue.

The mixture was shaken with glass beads for 12 minutes and then a solution of 21 g of vinyl acetate-vinyl laureate copolymer (Vinnapas B 100/VL 20 of Wacker Chemie GmbH, Germany) in 80 g of toluene was added.

The resulting dispersion was shaken for 15 minutes with glass beads and was applied to form a layer on a polyethylene terephthalate foil coated on each side with a dispersion of carbon in cellulose acetate butyrate. The applied layer was dried with hot air and had a dry weight of 20 g per $m^2$.

The photoconductive element so produced could be charged up to 356 Volt and had a negative charge density of 0.77 m Coulomb per $m^2$. Using the light source described in Example 1, discharging it down to a residual voltage of 3 Volt required 25 m Joule per $m^2$. In the same copying machine as employed in Example 1 the result was almost identical to that obtained with an electrophotographic element according to Example 2.

In this case also the separation into liquid phases was demonstrated by using the same formula but leaving out the zinc oxide. In the presence of zinc oxide, spheres having a diameter of approximately 8 μm were measured in the dispersion, which spheres after drying of the layer formed were discernable as agglomerates of approximately 3 μm in diameter.

EXAMPLE 5

A solution was prepared by mixing 4 g of ethyl cellulose (type N 4 of Hercules Powder Co.) in 80 g of toluene.

The following ingredients were added:

100 g of zinc oxide (Electrox 2500 sold by Durham Chemicals Ltd., England) and 0.4 g of bromochlorophenol blue.

The mixture was dispersed for 12 minutes by shaking with glass beads and then a solution of 26 g of vinyl acetate-vinyl laureate copolymer (Vinnapas B 100/VL 20 of Wacker Chemie GmbH, Germany) in 60 g of toluene was added.

The resulting mixture was dispersed by shaking it with glass beads for 15 minutes and then was applied to form a layer on a polyethylene terephthalate foil coated on each side with a dispersion of carbon in a cellulose acetate butyrate copolymer. After drying with hot air the weight of the applied layer was 20 g per $m^2$.

The photoconductive element obtained could be charged up to 250 Volt and had a negative charge density of 0.46 m Coulomb per $m^2$. Using the same light source as described in Example 1, discharging it down to a potential of 14 Volt required 30 m Joule per $m^2$.

In the same copying machine as employed in Example 1 a very high useful life was established. The separation into liquid phases was demonstrated by using the same formula but leaving out the zinc oxide. In the presence of zinc oxide, spheres having a diameter of approximately 9 μm were measured in the dispersion, which spheres after drying of the layer formed were discernable as agglomerates having a diameter of approximately 3.5 μm.

The photoconductive layer of this example was photographed with a scanning electron microscope at a thousand-fold scale of enlargement.

FIG. 1 of the accompanying drawing is a reproduction of the micro-photograph, in which the more or less spherical agglomerates are clearly visible.

Figure 2:
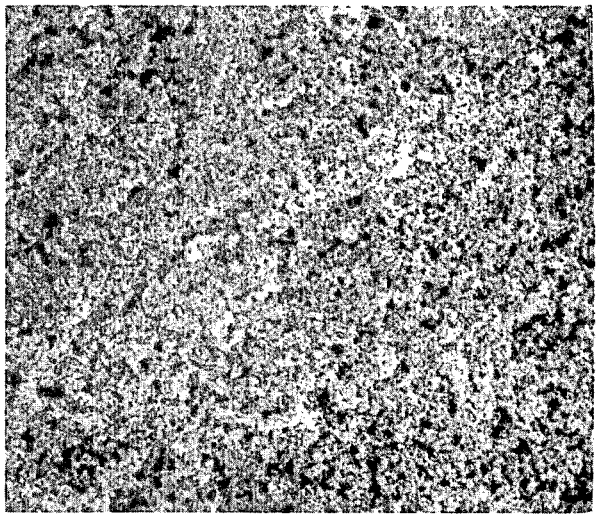

FIG. 2 of the drawing is a reproduction of a microphotograph made for comparison at the same scale of enlargment, but in this case showing the quite different structure of a photoconductive zinc oxide-binder layer containing only one binding agent.

EXAMPLE 6

To a mixture of 8.75 g of a 50% by weight solution of a styrene-ethyl acrylate copolymer in toluene (E 048 of De Soto Inc., USA), 100 g of toluene and 100 g of monochlorobenzene, the following were added:

100 g of pink zinc oxide (prepared according to the U.K. Patent Specification No. 1,489,793) and 0.8 g of bromochlorophenol blue.

The dispersion was shaken with glass beads for 15 minutes and then 15 g of polyvinyl carbazole (Luvican M 170 of BASF) dissolved in 100 g of monochlorobenzene were added.

The resulting dispersion was shaken with glass beads for 15 minutes and then was applied to form a layer having a dry weight of 20 g per $m^2$ on an electrically conductive substrate. The layer was dried with hot air to constant weight.

The photoconductive element so produced could be charged up to 265 Volt, and the negative charge density at maximum charging was 1 m Coulomb per $m^2$. Discharging the element down to a residual voltage of 2 Volt required a light energy of 15 m Joule per $m^2$, using the light source mentioned in Example 1. The element was used 10,000 times for copying operations, each time by charging, imagewise exposing, developing, and transfer of the powder image to paper via a heated intermediate medium. The copies obtained were of reasonably good quality, but the copying process in this case required rather critical adjustments because the layer showed a rather high rate of dark decay; a loss of 30 Volt after one second was measured. Yet in contrast, a similar photoconductive layer prepared from zinc oxide and polyvinyl carbazole but without styrene-ethyl acrylate resin was entirely unusable; it could be charged up only to 51 Volt and it lost two thirds of this potential within one second.

EXAMPLE 7

A solution was prepared by mixing:

5 g of cellulose acetate propionate (482/20 of Eastman Kodak USA), 64 g of toluene and 16 g of 2-methoxy-ethanol.

The following were added to the solution:

100 g of pink zinc oxide (prepared according to the U.K. Patent Specification No. 1,489,793) and 0.375 g of bromochlorophenol blue.

The resulting dispersion was shaken in a holder with glass beads for 12 minutes and then a solution containing:

25 g of polyvinyl butyral (Butvar B76 of Shawinigan Ltd England), 8 g of 2-methoxy-ethanol and 72 g of toluene was added.

This dispersion was shaken for a further 12 minutes with glass beads, and then a layer of it was applied to a plastic foil coated with a thin layer of palladium. The dispersion layer was dried with hot air and had a dry weight of 24 g per $m^2$.

The resulting photoconductive element could be charged up to 322 Volt. It then was discharged down to 12 Volt by a light energy of 18 m Joule per $m^2$, using the light source described in Example 1. The negative charge density at maximum charging was 0.40 m Coulomb per $m^2$. The photoconductive layer was still in a well usable condition after the production of 5000 good copies with it in the same copying machine as used in Example 1.

EXAMPLE 8

A photoconductive element prepared in the same manner with the same constituents as described in Example 7, but without the addition of cellulose acetate propionate, showed a negative charge density of 1.15 m Coulomb per $m^2$, and considerable damaging of the photoconductive surface was observed after the production of 2000 copies with this element.

EXAMPLE 9

A photoconductive element prepared in the same manner with the same constituents as described in Example 7, but in which the polyvinyl butyral was replaced by 50 g of a 50% by weight solution of a styrene acrylate resin (E 048 of De Soto Inc., USA), gave substantially the same results as the photoconductive element of Example 7.

We claim:

1. A reusable electrophotographic element comprising a substrate suited for use in electrophotography and a photoconductive layer containing sensitized zinc oxide particles in admixture with binding agents that are mutually incompatible, including a first binding agent that has a higher affinity to zinc oxide than a second of said binding agents and is largely deposited on said zinc oxide particles, said first binding agent being a macromolecular compound having an average molecular weight of at least 12,000 and being present in said layer in an amount of 1.5 to 9% by weight calculated on the zinc oxide particles, and the amount of said second binding agent in said layer being substantially larger than that of said first binding agent, said layer being substantially porous and having a negative charge density of at most 1 m Coulomb per $m^2$ and consisting essentially of agglomerates formed in situ in a matrix consisting essentially of said second binding agent, said agglomerates being of between 2.5 and 6 μm in diameter and being stuck together by portions of said second binding agent and each consisting essentially of a collection of said zinc oxide particles enveloped in a body of said first binding agent.

2. An electrophotographic element according to claim 1, said first binding agent being present in said layer in an amount of 4 to 8% by weight calculated on the zinc oxide, and the amount of said second binding agent by weight being approximately 3 to 6 times that of said first binding agent.

3. An electrophotographic element according to claim 1 or 2, said first binding agent being a phenoxy resin, polyester, cellulose ester or polyvinyl acetal and said second binding agent being an acrylate resin and/or a polyvinyl ester.

4. An electrophotographic element according to claim 1 or 2, said first binding agent being a phenoxy resin and said second binding agent being a styrene-acrylate copolymer.

5. An electrophotographic element according to claim 1 or 2, said photoconductive layer having a negative charge density in the range of from 0.4 to 0.7 m Coulomb per $m^2$.

6. An electrophotographic element according to claim 5, said first binding agent being a phenoxy resin, polyester, cellulose ester or polyvinyl acetal and said second binding agent being an acrylate resin and/or a polyvinyl ester.

* * * * *